US006202324B1

(12) United States Patent
Whitlock

(10) Patent No.: US 6,202,324 B1
(45) **Date of Patent: *Mar. 20, 2001**

(54) FOOTWEAR SYSTEM FOR HUNTING

(76) Inventor: William Scott Whitlock, 1447 S. Oakmont, Springfield, MO (US) 65809

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,271

(22) Filed: Jul. 2, 1998

(51) Int. Cl.[7] ..... A43B 3/16

(52) U.S. Cl. ..... 36/7.1 R; 36/113; 36/3 B; 36/87

(58) Field of Search ..... 36/113, 7.1 R, 36/7.3, 55, 3 R, 3 B, 87

(56) References Cited

U.S. PATENT DOCUMENTS

| | | | |
|---|---|---|---|
| Re. 34,890 | * | 4/1995 | Sacre . |
| 3,176,416 | * | 4/1965 | Seegert . |
| 4,120,101 | * | 10/1978 | Drew . |
| 4,186,502 | | 2/1980 | Foster . |
| 4,304,055 | * | 12/1981 | Hanson . |
| 4,317,296 | * | 3/1982 | Hanson . |
| 4,722,477 | | 2/1988 | Floyd . |
| 5,024,008 | | 6/1991 | Maples . |
| 5,383,236 | | 1/1995 | Sesselmann . |
| 5,461,814 | | 10/1995 | Reid et al. . |
| 5,678,241 | | 10/1997 | Vickers . |

OTHER PUBLICATIONS

Cabela's Fall 98 Catalog, pp 134–135, 174, 178 1998.
Cabela's Catalog, p. 66 (date unknown).

* cited by examiner

*Primary Examiner*—Ted Kavanaugh
(74) *Attorney, Agent, or Firm*—Shook, Hardy & Bacon L.L.P.

(57) ABSTRACT

An article of footwear comprises an upper connected to a sole that is formed of an odorless, nonabsorbent material such that there is no detectable material odor upon contact with a ground surface. In addition, the transfer of scent, such as human scent, at least through the sole from the interior chamber to ground is at least substantially reduced or prevented. In a preferred embodiment, the upper is also constructed of an odorless, nonabsorbent material. According to a further embodiment of the invention, an odorless footwear system comprises an overshoe and a liner adapted for insertion into the overshoe. Both the overshoe and liner may be constructed of odorless, nonabsorbent materials. Preferably, the liner is arranged to completely cover a shoe or boot installed in the liner. Accordingly, scent that may emanate from a person through the shoe or boot, and odor from the shoe or boot material itself are at least substantially enclosed in the liner. Both the overshoe and liner leave no detectable material odor upon contact with ground or other surface.

7 Claims, 3 Drawing Sheets

FOOTWEAR SYSTEM FOR HUNTING

BACKGROUND OF THE INVENTION

1. Field of the Invention

This invention relates to footwear, and more particularly to odorless footwear for hunters, trappers and other outdoor enthusiasts.

2. Description of the Related Art

It is widely known that wild game and other animals have a keenly acute sense of smell, especially for odors that are not indigenous to their natural habitat. Such odors may emanate from humans while attempting to position themselves in close proximity to the game, and may include bodily secretions such as perspiration, oils, halitosis, etc. Many have attempted to mask these bodily odors through the use of artificial scents from deodorants, scented soaps, powders, colognes, perfumes, etc. Such scents do not naturally occur in the natural habitat of game animals and therefore serve to alert them to potential danger. Hunters and other outdoor enthusiasts have additionally resorted to spraying their clothing with naturally occurring aromatic scents, such as deer lure, in an attempt to mask their own odors. However, the wild game may sense both the natural scent and odors emanating from the person.

The feet are an especially vulnerable area for humans since the feet tend to be enveloped in protective layers of footwear, such as socks, shoes, boots, etc. In this environment, the feet may perspire and emanate strong odors that are sometimes even perceptible to humans. Foot perspiration and odor can be absorbed by footwear and transferred to the ground as the person walks, resulting in a human scent trail that is easily recognizable by animals. Portions of the footwear such as the sole or upper, are typically constructed of leather, porous plastics, fibrous material, etc. These types of materials are especially subject to the absorption and transfer of odors emanating from the feet.

In an attempt to prevent a human scent trail while walking or hiking, it is common to wear rubber boots in place of hiking or hunting boots. U.S. Pat. No. 5,024,008 issued to Maples recognizes that while rubber boots may be effective in trapping human odors, they can become uncomfortable to the wearer over time. This is especially true during long hikes over rough terrain. Maples proposes a solution to this problem by providing a rubber overshoe that fits over the sole of a hunting boot to thereby prevent mutual contact between the boot and ground. A scent dispenser is attached to the overshoe for dispensing scent to the ground as a hunter walks. Although this system may be effective for preventing human scent from transferring through the sole of a boot to the ground, the material of the boot upper, eyelets, and stitching apertures can still transfer odors. Moreover, and most importantly, the rubber material itself, whether it is formed into a boot, overshoe, or sole, has its own distinct odor. The present inventor as well as numerous hunters, trappers, guides, videographers, and photographers have observed that animals identify and relate human presence or danger to a scent trail left by footwear constructed at least in part of rubber. As with other scents foreign to their natural environment, the rubber scent serves to alert the animals to potential danger.

SUMMARY OF THE INVENTION

These and other problems of the prior art are overcome by the provision of an article of footwear that utilizes an odorless material to substantially reduce or eliminate odors that are normally generated from prior art materials.

According to one embodiment of the invention, an article of footwear comprises an upper with a toe portion connected to a heel portion by a pair of opposed side portions, and a sole connected to the upper. The sole extends longitudinally between the toe and heel portions and laterally between the side portions to form an interior chamber together with the upper. At least the sole is constructed of an odorless, nonabsorbent material. With this arrangement, odor that is normally generated by prior art materials, such as rubber, leather, etc., is at least substantially eliminated to leave no detectable material odor trace on a ground surface. In addition, the transfer of scent, such as human scent, deodorant soap scent, etc., at least through the sole from the interior chamber to ground is at least substantially reduced or eliminated. In a preferred embodiment, the upper is also constructed of an odorless, nonabsorbent material.

A cavity may be integrally molded with the sole for receiving and holding a scent pad. The cavity can have a lower wall with openings extending therethrough for transferring scent from a scent pad to ground, when the scent pad is installed in the cavity.

According to a further embodiment of the invention, an odorless footwear system comprises an overshoe and a liner adapted for insertion into the overshoe. The overshoe has an upper with a toe portion connected to a heel portion by a pair of opposed side portions. A sole is connected to the upper and extends longitudinally between the toe and heel portions and laterally between the side portions to form an interior chamber together with the upper. The overshoe is constructed of an odorless, nonabsorbent material. The liner has a foot portion and a leg portion connected to the foot portion. The leg and foot portions are adapted to receive a person's leg and a shoe or boot, respectively. The liner is also constructed of an odorless, nonabsorbent material. With this arrangement, scent that may emanate from a person through the shoe or boot, and odor from the shoe or boot material itself are at least substantially enclosed in the liner. Additionally, the transfer of material odor to ground from the overshoe and liner is at least substantially reduced or prevented, when compared to the prior art materials.

Preferably, the leg portion of the liner has a length that completely covers the shoe or boot when the shoe or boot is installed in the liner. In one embodiment, the leg portion is knee length. In another embodiment, the leg portion is hip length. If the sole of the foot portion of the liner is made sufficiently thick and rugged, the overshoe may be eliminated.

It is to be understood that the term "odorless" as used herein refers to materials without odors or materials with inherent odors that are virtually undetectable by animals, such as deer, with an acute sense of smell. It is also to be understood that the term "overshoe" as used herein refers to a covering for any type of footwear, such as socks, boots, shoes, etc.

BRIEF DESCRIPTION OF THE DRAWINGS

The invention will now be described with reference to the drawings in which.

DETAILED DESCRIPTION OF THE PREFERRED EMBODIMENTS

Figure 1:
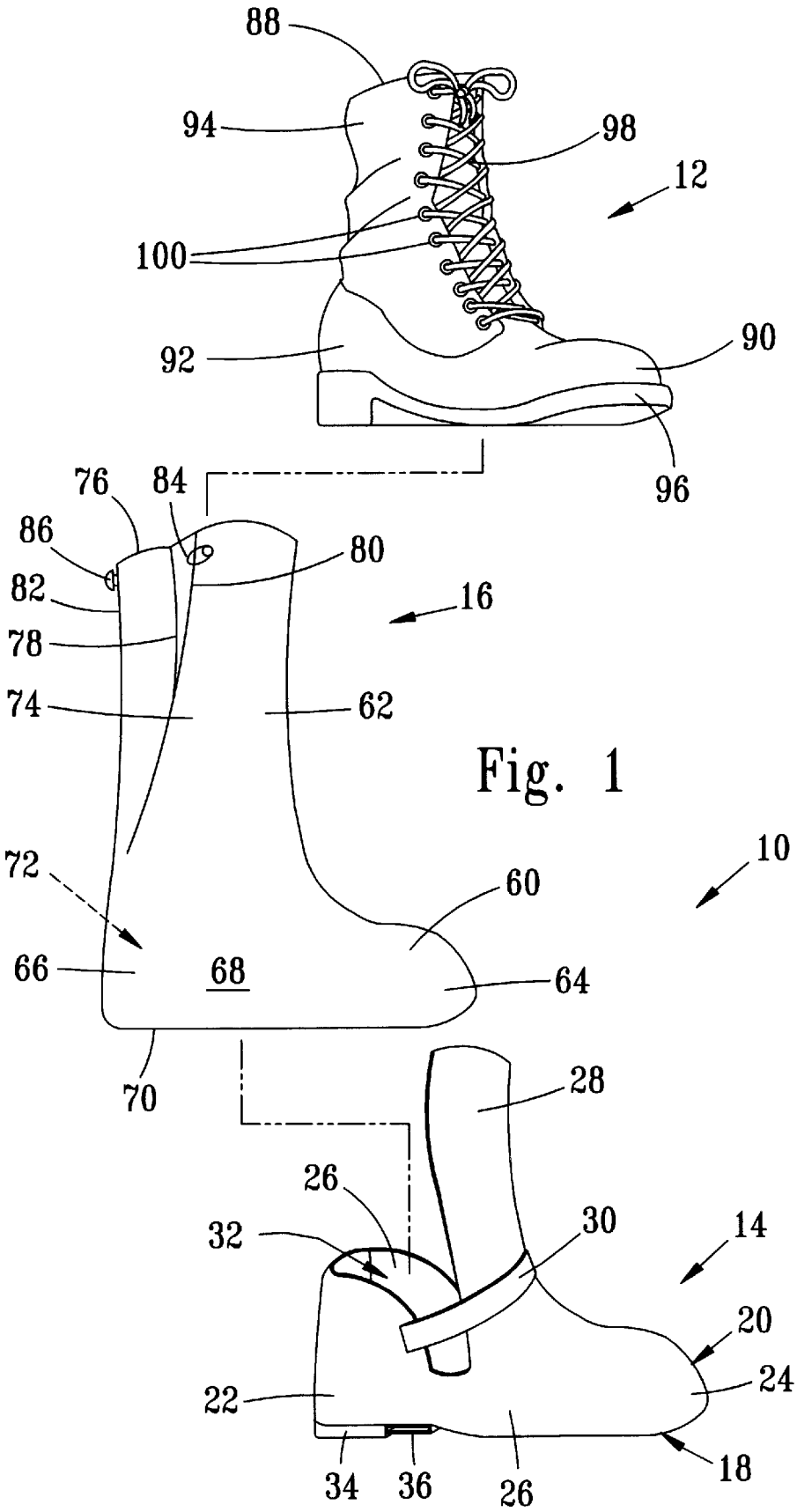
FIG. 1 is an exploded perspective view of an odorless footwear system for a hunting boot according to the invention.

Referring now to the drawings, and to FIG. 1 in particular, an odorless footwear system 10 for installation over a boot 12 or other footwear is illustrated. The odorless footwear system 10 comprises an overshoe 14 and a liner 16. The overshoe 14 includes a sole 18 and an upper 20. The sole 18 and upper 20 are preferably integrally molded of an odorless, nonabsorbent material to form a unitary structure during the manufacturing process. Suitable materials include odorless polyvinyl chloride, odorless polyurethane, odorless polyethylene, polytetrafluoroethylene (PTFE), and other materials that may be generally classified as food grade.

The upper 20 includes a heel portion 22 connected to a toe portion 24 by a pair of side portions 26. A tongue 28 extends generally upwardly from the toe and side portions. A strap 30 has a first end that is attached to one of the side portions 26 and a second end that extends around the tongue 28 and fastens to the opposite side portion 26 for securing the overshoe 14 with the liner 16 and boot 12 through well-known fastening means, such as buckles, snaps, hook and loop material, etc. Although one strap is shown, it is to be understood that more straps can be provided.

The sole 18 is preferably thicker than the upper 20, and extends longitudinally from the heel portion 22 to the toe portion 24 and laterally between the side portions 26 to form a fluid-tight interior compartment 32. The interior compartment 32 is sized for receiving the liner 16 and boot 12, as will be described in greater detail below.

Figure 2:
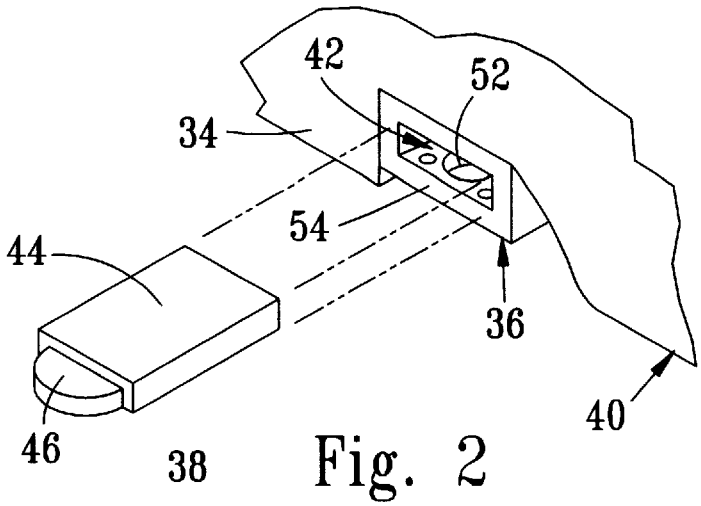
FIG. 2 is an enlarged perspective view of a scent pad and scent pad holder forming part of the odorless footwear system according to the invention.
Figure 3:
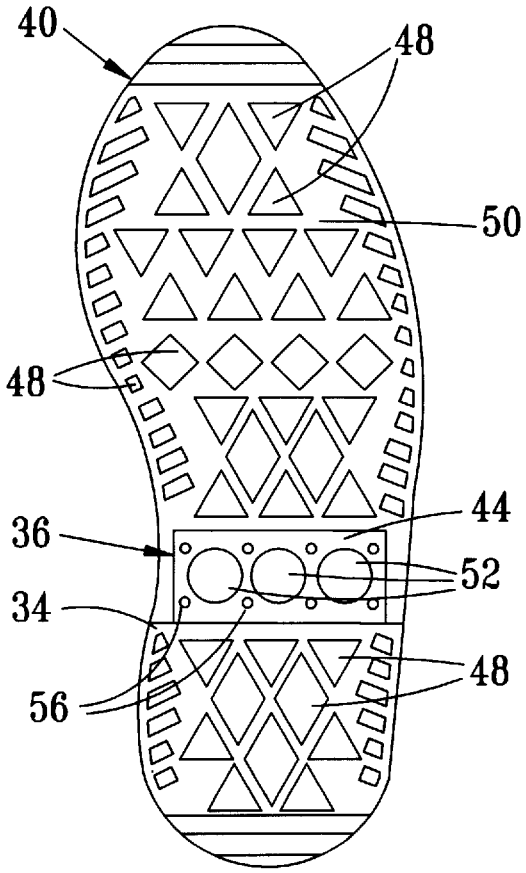
FIG. 3 is a bottom plan view of an odorless sole according to the invention.

As illustrated in FIGS. 2 and 3, the sole 18 includes a heel 34 and a holder 36 for a disposable scent-dispensing pad 38. Preferably, the heel 34 and holder 36 are integrally molded with the sole, but can be formed separately and then attached to the bottom 40 of the sole through adhesive bonding, ultrasonic welding, or other well-known techniques. The holder 36 includes a rectangular cavity 42 that is sized to receive and hold the scent pad 38. Preferably, the pad 38 is held by friction within the cavity 42. Depressions 48 are molded into the bottom 40 of the sole 18 in various shapes and patterns to form a treaded lower surface 50. Although a particular treaded pattern is illustrated; it is to be understood that any type of desired pattern may be formed into the bottom 40 of the sole 18. If desired, integrally molded film hinges (not shown) or other types of hinges may be located at bending areas of the sole, especially if the sole is constructed of a relatively stiff material.

The scent pad 38 includes a rectangular body portion 44 that fits within the cavity 42 and an integrally formed tab 46 that normally projects from the cavity when the pad is installed. The tab 46 is sized to be grasped by the index finger and thumb of a user to facilitate installation and removal of the pad 38. Preferably, the scent pad 38 is formed of a felt material, although a sponge or any other suitable absorbent or scented material can be used. The felt material can be constructed of woven or nonwoven natural fibers, such as wool, and/or man-made fibers such as synthetic polymers, and impregnated with one or more well-known animal attracting scents. Preferably, the scent pad is constructed of an odorless material so that only the animal attracting scent can be detected. Although the scent pad 38 and cavity 42 are shown as rectangular in cross-section, it is to be understood that they may be formed into other complementary shapes.

A set of large openings 52 and smaller openings 56 extend from the cavity 42 through a bottom wall 54 of the holder 36 so that animal attracting scent from the scent pad 38 may be transmitted to the ground when the overshoe 14 is in use. As best shown in FIG. 3, the large openings 52 are preferably arranged linearly along the bottom wall 54 and the smaller openings 56 are located at circumferentially spaced intervals around each large opening.

Referring again to FIG. 1, the liner 16 comprises a bottom wall or sole 70 connected to an upper defined by a foot portion 60 and a leg portion 62. The sole 70, foot portion 60 and leg portion 62 are preferably integrally molded together during manufacture to form a unitary structure. The foot portion includes a toe area 64 connected to a heel area 66 through side walls 68. The sole 70 extends longitudinally from the heel area 66 to the toe area 64 and laterally between the side walls 68 to form a moisture-tight interior compartment 72 (shown in dashed lines). The interior compartment 72 is sized for receiving the boot 12.

The leg portion 62 is formed as a continuous wall 74 with an open upper end 76. The wall 74 includes an outwardly facing, generally vertically extending crease 78 and a pair of inwardly facing, generally vertically extending creases 80 and 82 formed on opposite sides of the crease 78. The creases 78, 80 and 82 permit expansion of the leg portion 62 for insertion of the boot 12 into the liner 16 and collapse of the liner around a wearer's leg after installation of the boot. An elastic loop 84 is mounted adjacent the crease 80 and a button 86 is mounted adjacent the crease 82 for securing the upper end 76 of the leg portion 62 snugly around the wearer's leg. If desired, a second button (not shown) may be circumferentially spaced from the first button 86 for adjustment of the liner to different leg sizes. Alternatively, the elastic loop and button may be replaced with other fastening means such as snaps, straps, hook and loop material, etc. In yet another configuration, a continuous elastic member (not shown) may be formed around the perimeter of the upper end 76 for naturally biasing the upper end toward the wearer's leg. Preferably, the liner is constructed of a heavy mil plastic material that is nonabsorbent, odorless and fairly uniform in thickness throughout the leg and foot portions. Alternatively, if the liner is to be disposable, the liner may be constructed of a lighter mil material. As with the overshoe 14, suitable materials for the liner 16 include odorless polyvinyl chloride, odorless polyurethane, odorless polyethylene, PTFE, and other materials that may be generally classified as food grade. Preferably, the material has a thickness of about 4 mil. However, material thickness in the range of 0.1 mil to 10 mil or more may be used.

Figure 4:
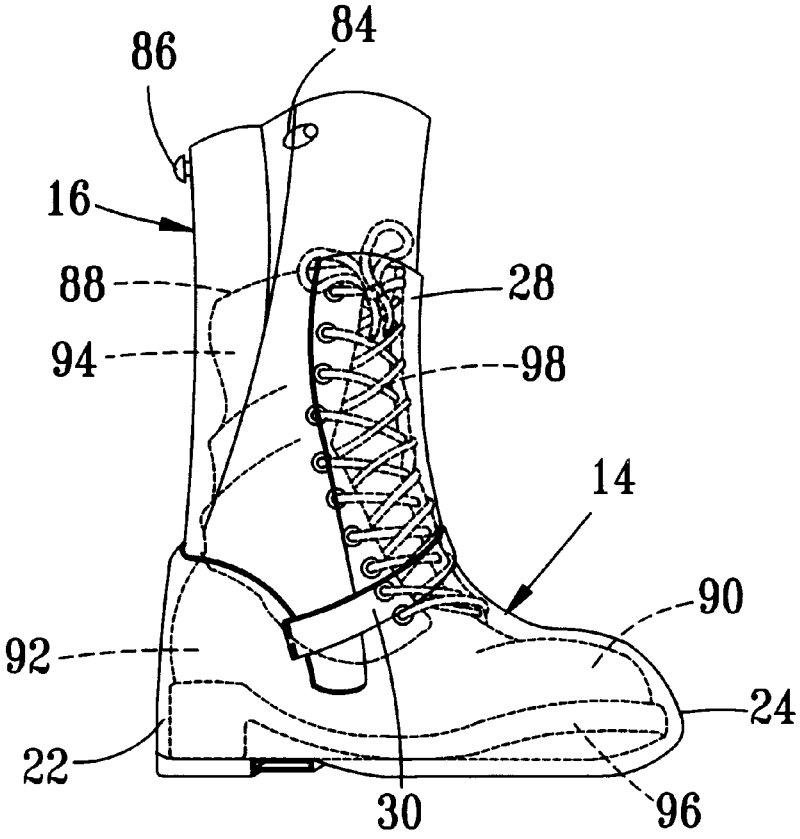
FIG. 4 is an assembled perspective view of the odorless footwear system of FIG. 1 with a hunting boot installed and shown in hidden line.

With reference now to FIGS. 1 and 4, the boot 12 is first placed on a person's foot and then installed into the liner 16 such that a toe end 90 and heel end 92 of the boot is in alignment with the toe area 64 and heel area 66, respectively, of the liner in the interior compartment 72. The upper end 76 of the liner is then secured around the person's leg by wrapping the elastic loop 84 around the button 86. Preferably, the upper end 76 of the liner 16 extends beyond the upper end 88 of the boot 12. In this manner, the boot 12 is completely enclosed within the liner 16. Odors that may transfer through the boot upper 94 and sole 96 from the person's foot are effectively trapped within the confines of the liner 16. Thus, the liner acts as a first odorless barrier between the foot and ground. The boot and liner are then installed into the overshoe 14 such that the toe area 64 and heel area 66 of the liner is in alignment with the toe portion 24 and heel portion 22, respectively, of the overshoe in the interior compartment 32. The strap 30 is then secured to hold the overshoe and liner together. Preferably, the tongue 28 covers the lacing 98 and eyelets 100 of the boot 12 such that the liner 14 is pressed against the lacing and eyelets. With this arrangement, the overshoe adds durability to the liner and offers a second odorless barrier between the foot and ground. With the human scent contained within the liner 16, only the scent from the pad 54 will be transferred to the ground and detected by the game animals.

Figure 5:
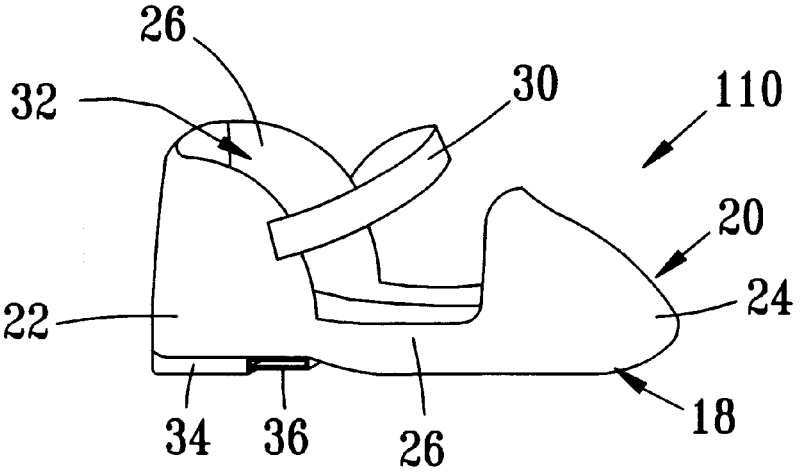
FIG. 5 is a further embodiment of an odorless overshoe according to the invention.

With reference now to FIG. 5, an overshoe 110 according to a second embodiment of the invention is illustrated, wherein like parts in the previous embodiment are represented by like numerals. Overshoe 110 is similar to the overshoe 14 with the removal of tongue portion 28. The heel portion 22 and toe portion 24 along with strap 30 serve to hold the overshoe 110 and liner together.

Although the liner 16 has been described for use with an overshoe, it is to be understood that, the liner can be used without the overshoe, especially if the bottom wall 70 is constructed of thicker material or formed similar to the sole 18 of the overshoe 14. Thus, the liner 16 can have an integrally formed sole of relatively thick odorless material and an upper defined by the continuous wall 74 of relatively thin odorless material. In addition, the upper may extend to knee-height or hip-height to further reduce the risk of odor transfer from the person to the ground or surrounding environment. For hip-length liners, a connection strap (not shown) can be provided for holding the liner in the proper position on a wearer. The connection strap preferably has one end that attaches to the liner and a second end that loops around a belt and then reattaches to the liner, preferably in the same manner as the elastic loop and button previously described.

Alternatively, although less effective, the overshoe can be used without the liner to separate the sole 96 of the boot from the ground to thereby prevent odor transfer directly from the boot to ground, whether it be the odor of the boot material itself and/or odors transferred through the boot material.

Instead of the overshoe, a footwear device, such as a boot or shoe, can be constructed partially or entirely out of odorless material. For example, a boot can be constructed with at least the sole formed of odorless, nonabsorbent material to eliminate odors that would normally be present on a sole constructed of ordinary materials, such as leather or rubber, and to prevent the transfer of human scent to the ground. The upper may also be constructed partially or entirely of odorless material.

While particular embodiments of the invention have been shown, it will be understood that the invention is not limited thereto since modifications may be made by those skilled in the art, particularly in light of the foregoing teachings.

The embodiments for which an exclusive property or privilege is claimed are defined as follows:

1. A footwear system for use in an environment where game animals may be present, the footwear system comprising:

an overshoe having an upper with a toe portion connected to a heel portion by a pair of opposed side portions; a flexible sole connected to the upper and extending longitudinally between said toe and heel portions and laterally between said side portions to form an interior compartment together with said upper, said heel portion having a first height that extends from said sole to an upper edge of said heel portion;

a flexible liner adapted for removable installation into said interior compartment; said liner having a foot portion with a sole and a leg portion connected to said foot portion, said leg portion and said foot portion defining a liner interior that is adapted to receive a person's leg and a shoe or boot, respectively, and said leg portion having a second height that extends from said sole of said foot portion to an upper edge of said leg portion, said second height being greater than said first height; and material a boot having a foot portion installed in the liner foot portion and a leg portion installed in the liner leg portion, wherein said first height of said overshoe has a length that is shorter than a length of the leg portion of the boot, and said second height of said liner has a length that is longer than the length of the leg portion of the boot such that the liner completely covers the boot.

2. A footwear system according to claim 1, wherein said sole and upper of said liner are of uniform thickness.

3. A footwear system according to claim 2, wherein said sole and upper of said liner are integrally molded as a unitary piece.

4. A footwear system according to claim 1, wherein said sole of said overshoe is thicker than said upper of said overshoe.

5. A footwear system according to claim 4, wherein said sole and upper of said overshoe are integrally molded as a unitary piece.

6. A footwear system according to claim 1, wherein said upper includes a tongue that substantially covers a lacing of said shoe or boot when the shoe or boot is installed in the liner and the liner is installed in the interior chamber.

7. A footwear system according to claim 1, wherein said leg portion is adjustable to accommodate different leg sizes.

* * * * *